US005319313A

United States Patent [19]

Vogel et al.

[11] Patent Number: 5,319,313

[45] Date of Patent: Jun. 7, 1994

[54] POWER COUPLER WITH ADJUSTABLE COUPLING FACTOR FOR ACCELERATOR CAVITIES

[75] Inventors: Hanspeter Vogel, Wuppertal; Dietmar Kiehlmann, Overath; Peter Schäfer, Troisdorf, all of Fed. Rep. of Germany; Ernst Haebel, Meyrin, Switzerland; John McGill, Duncanville, Tex.

[73] Assignees: Siemens AG, Munich, Fed. Rep. of Germany; The United States of America as represented by the United States Department of Energy, Washington, D.C.

[21] Appl. No.: 677,112

[22] Filed: Mar. 29, 1991

Related U.S. Application Data

[63] Continuation-in-part of Ser. No. 535,383, Jun. 8, 1990, abandoned.

[51] Int. Cl.[5] ..... H01P 5/08; H05H 7/02; H05H 7/20

[52] U.S. Cl. ..... 328/233; 315/5.41; 333/230; 333/99.005; 505/866

[58] Field of Search ..... 333/24 C, 26, 230, 248, 333/995; 315/5.41; 328/233; 505/854, 866

[56] References Cited

U.S. PATENT DOCUMENTS

| | | | |
|---|---|---|---|
| 2,873,430 | 2/1959 | Tomiyasu | 333/248 X |
| 3,214,684 | 10/1965 | Everitt | 333/230 X |
| 3,843,863 | 9/1974 | Fitzmayer | 333/33 X |
| 4,002,943 | 1/1977 | Regan et al. | 333/26 X |
| 4,286,192 | 8/1981 | Tanabe et al. | 315/5.41 |
| 4,642,523 | 2/1987 | Nakanishi et al. | 333/230 X |
| 4,727,343 | 2/1988 | Stone | 333/232 |
| 5,089,785 | 2/1992 | Hand | 315/5.41 X |

FOREIGN PATENT DOCUMENTS

| | | | |
|---|---|---|---|
| 2126476 | 5/1971 | Fed. Rep. of Germany . | |
| 3208655 | 3/1982 | Fed. Rep. of Germany . | |
| 700 | 1/1989 | Japan | 328/233 |

OTHER PUBLICATIONS

Proceedings of the 1989 IEEE Particle Accelerator Conference, Mar. 20–23, 1989, Chicago, Ill. pp. 1859 & 1860.

IEEE Transactions on Nuclear Science, vol. ns 22, No. 3, Jun. 1975, pp. 1269–1272.

*Primary Examiner*—Robert J. Pascal
*Assistant Examiner*—Benny T. Lee
*Attorney, Agent, or Firm*—Herbert L. Lerner; Laurence A. Greenberg

[57] ABSTRACT

An accelerator includes a beam tube having a cavity with a central axis along which particles can be accelerated. A radio frequency power coupling device couples the cavity to a high frequency power source. The coupling device includes a coaxial waveguide having a central axis, an outer conductor and an inner conductor. The outer conductor is fixed relative to the cavity defining an angle between the central axis of the cavity and the central axis of the coaxial waveguide. An external drive moves the inner conductor along the central axis of the coaxial waveguide.

15 Claims, 2 Drawing Sheets

POWER COUPLER WITH ADJUSTABLE COUPLING FACTOR FOR ACCELERATOR CAVITIES

CROSS-REFERENCE TO RELATED APPLICATION

This application is a Continuation-in-Part of application Ser. No. 535,383, filed Jun. 8, 1990 now abandoned.

BACKGROUND OF THE INVENTION

1. Field of the Invention

The invention relates to a power coupler with an adjustable coupling factor for accelerator cavities, in particular superconducting accelerator cavities.

2. Description of the Related Art

High-frequency resonators or accelerator cavities of beam tubes which are used for particle acceleration and/or applications related thereto in accelerator installations include one or more different high-power coupling devices, among other components. Such high-power coupling devices couple the power (HF-power up to 200 kW) to accelerate the particle beam in high-frequency resonators or accelerator cavities of the beam tubes. Usually, such accelerator cavities are operated at resonant frequencies ranging from about 40 MHz to about 5 GHz. Generally speaking, the resonant frequencies of accelerator cavities lie in the high-frequency (HF) domain, and particularly in the radio-frequency (RF) range.

High-power coupling devices are in the form of rod couplers or loop couplers. A rod coupler usually includes a coaxial waveguide connected to the accelerator cavity to be powered or to the beam tube in the vicinity of the cavity; the coaxial waveguide has a tube-shaped outer conductor and a rod-shaped inner conductor which is arranged in the outer conductor and serves as an antenna to transfer HF-power to the cavity. Preferably, rod couplers are used in conjunction with accelerator cavities which are operated at resonant frequencies ranging below about 1 GHz, in particular at several hundred MHz.

Due to the rigid mechanical construction of such couplers, the strength of the coupling, which is expressed as the so-called coupling factor, is fixed and cannot readily be adjusted in dependence of the operational requirements.

In accelerator applications, a typical mode of operation of an accelerating cavity is to sustain an electromagnetic field, oscillating with the resonance frequency of the cavity; the amplitude is predetermined to correspond to the amount of acceleration of particles in a beam passing through. The amplitude of the field is kept constant by providing a high-frequency signal having sufficient power, and coupling an effective fraction of the signal into the cavity by means of a suitable power coupling device. In the absence of a particle beam, the HF-power coupled into the cavity matches the amount of that dissipated in the cavity; for a typical superconducting cavity, this may be approximately 10 W. However, an accelerated beam of particles passing through the cavity increases the HF-power afforded to sustain the electromagnetic field at its predetermined amplitude, as the acceleration process affords a power transfer from the cavity to the beam.

In typical applications, the HF-power transferred to a beam of particles may well amount to several hundred kilowatts. Since HF-power sources capable of varying their power output between about 10 W and about 200 kW are not readily available, an accelerating cavity is usually powered by a HF-power source delivering a signal of constant and sufficiently large amplitude which is coupled to the cavity by means of a power coupling device having a coupling factor adjusted so that the desired amount of power is transferred into the cavity, according to the operating conditions, including the intensity of the beam.

Until now this problem has been solved by the use of different couplers, each adapted to a different purpose and each being selectively connected to the accelerator cavity, according to the specific operational requirements.

However, that method is not flexible and it necessitates additional assembly procedures when the operating conditions change.

German patent specification DE 32 08 655 C2 discloses a power coupling device for a superconducting accelerator cavity with an adjustable coupling factor. That device comprises a coaxial waveguide with an outer conductor and a rod-shaped inner conductor connecting the cavity to a rectangular waveguide leading to a HF-power source. The outer conductor is rigidly fixed between the rectangular waveguide and the cavity, and the inner conductor projects from the coaxial waveguide through the rectangular waveguide to an external drive, and is movable relative to the outer conductor, so as to vary the coupling factor by varying the position of a tip of the inner conductor in the vicinity of the cavity. The rectangular waveguide has a first wall, where the outer conductor terminates leaving an opening into the coaxial waveguide, and a second wall opposite the first wall with another opening through which the inner conductor projects. However, the inner conductor has to be contacted to the second wall by a connection which should be an ideal electric short. According to that patent specification, such a short is approximated by a $\lambda/4$-transformer, which includes a number of conductive tubes of suitable length (approximately $\lambda/4$) and differing diameter arranged concentrically with the inner conductor and electrically contacted to the second wall. By dimensioning the transformers accordingly, a relatively small electric impedance close to a short circuit may be attained at the gap between the inner conductor and the second wall. However, the small electric impedance is still dependent on the geometrical configuration of the external drive for the inner conductor which may include cavities with dimensions and, accordingly, resonances which vary as the inner conductor is moved. This entails fluctuations of the impedance at the gap and, of course, may considerably limit the applicability of that power coupling device.

The afore-mentioned problem of electrically connecting the inner conductor of a coaxial waveguide to a wall of a tubular waveguide, especially a rectangular waveguide, might in some circumstances be solved by furnishing sliding contacts directly connecting the inner conductor to the wall; however, in conventional accelerator applications this solution is excluded because of the high electrical currents between the wall and the inner conductor. The currents correspond to the high HF-powers (up to 1 MW) which have to be handled; damage to the sliding contacts would be likely.

A superconducting single cell cavity for pion-beam compression is used at the Los Alamos Laboratory. The cavity operates at a resonant frequency near 400 MHz.

Since the beam load on the cavity is negligible in that particular application, the total quality factor Q of the cavity is essentially determined by the coupler, since the quality factor of a superconducting cavity without any coupling is generally extremely high and no effective load is present from a beam passing through the cavity, which in turn further impairs the quality factor Q. A compromise may be found between a high Q which is desirable for a low level of HF-power needed and a low Q which eases the frequency control of the HF-power source, as a rather low Q corresponds to a fairly high bandwidth of the cavity and consequently may allow a reduction of precision requirements for the frequency control. Besides, a sufficiently low Q assures that the impedance of the cavity is kept almost constant, if frequency variations are kept within reasonable and well achievable limits; accordingly, it is possible to avoid great mismatches which might adversely affect the HF-power source.

In such a situation a need has been found for a simple and reliable power coupler with adjustable coupling, in order to obtain flexibility in view of possible variation in operational conditions as well as to explore the boundaries of the above-mentioned range of Q.

SUMMARY OF THE INVENTION

It is accordingly an object of the invention to provide a power coupler with a adjustable coupling factor for accelerator cavities, in particular superconducting cavities, which overcomes the hereinafore-mentioned disadvantages of the heretofore-know devices of this general type and which provides for adjustable coupling.

With the foregoing and other objects in view there is provided, in accordance with the invention, in an accelerator including a beam tube having a cavity with a central axis along which particles can be accelerated by a high frequency field having a predetermined resonance wavelength $\lambda$ and a predetermined resonance frequency associated with the cavity, a high frequency power coupling device for coupling the cavity to a high frequency power source, the coupling device comprising a coaxial waveguide having a central axis, an outer conductor and an inner conductor, the outer conductor being fixed relative to the cavity defining an angle between the central axis of the cavity and the central axis of the coaxial waveguide, and an external drive for moving the inner conductor along the central axis of the coaxial waveguide; a tubular waveguide having a wall and a central axis defining an angle with the central axis of the coaxial waveguide, the wall defining first and second openings disposed opposite one another, the outer conductor terminating at the first opening defining an access for the high-frequency field from the tubular waveguide into the coaxial waveguide, the inner conductor extending through the tubular waveguide and projecting through the second opening; and a connection between the inner conductor and the wall, including an inner tube and an outer tube, each being electrically conductive and having a respective first tip projecting towards the first opening and a respective second tip projecting away from the first opening, the inner tube being disposed concentrically around the inner conductor and defining an inner transformer having an effective length of a first odd multiple of $\lambda/4$, the outer tube being disposed concentrically around the inner tube defining an outer transformer having an effective length of a second odd multiple of $\lambda/4$, the first tip of the inner tube being electrically connected to the first tip of the outer tube, the outer tube being electrically connected to the wall between the first and second tips, and sliding contacts disposed on the second tip of the outer tube, the inner conductor being slidable on and electrically connected to the sliding contacts, the sliding contacts and the second tip of the inner tube defining a gap thereinbetween.

In accordance with another feature of the invention, the cavity is a superconducting cavity.

In accordance with an added feature of the invention, the angle between the central axis of the coaxial waveguide and the central axis of the tubular waveguide is approximately 90°.

In accordance with a further feature of the invention, the inner conductor is movable through a distance of approximately 20–120 mm along the central axis of the coaxial waveguide by the external drive.

In accordance with an added feature of the invention, the angle between the central axis of the cavity and the central axis of the coaxial waveguide is approximately 90°.

In accordance with an additional feature of the invention, the inner conductor has a tip protruding up to a distance of approximately 0–120 mm from the beam tube.

In accordance with yet another feature of the invention, the external drive is a high precision positioning linear drive.

In accordance with yet an added feature of the invention, there are provided vacuum barriers disposed between the coaxial waveguide and the high frequency power source as well as between the coaxial waveguide and the external drive.

In accordance with yet an additional feature of the invention, the cavity is formed in the beam tube, and the outer conductor is connected to the beam tube in the vicinity of the cavity.

In accordance with yet a further feature of the invention, the tubular waveguide is a rectangular waveguide, the wall including a first substantially flat section and a second substantially flat section opposite to the first substantially flat section, the first opening being disposed in the first substantially flat section and the second opening being disposed in the second substantially flat section.

In accordance with yet an additional feature of the invention, the first odd multiple of $\lambda/4$ equals $\lambda/4$, and in accordance with yet another feature of the invention, the second odd multiple of $\lambda/4$ equals $\lambda/4$.

In accordance with yet an added feature of the invention, the predetermined resonance frequency is between 40 MHz and 5 GHz and in accordance with yet a further feature of the invention, the predetermined resonance frequency is between 40 MHz and 1 GHz.

In accordance with still another feature of the invention, the inner tube is cylindrical.

In accordance with a concomitant feature of the invention, the outer tube is cylindrical.

Other features which are considered as characteristic for the invention are set forth in the appended claims.

Although the invention is illustrated and described herein as embodied in a power coupler with an adjustable coupling factor for accelerator cavities, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
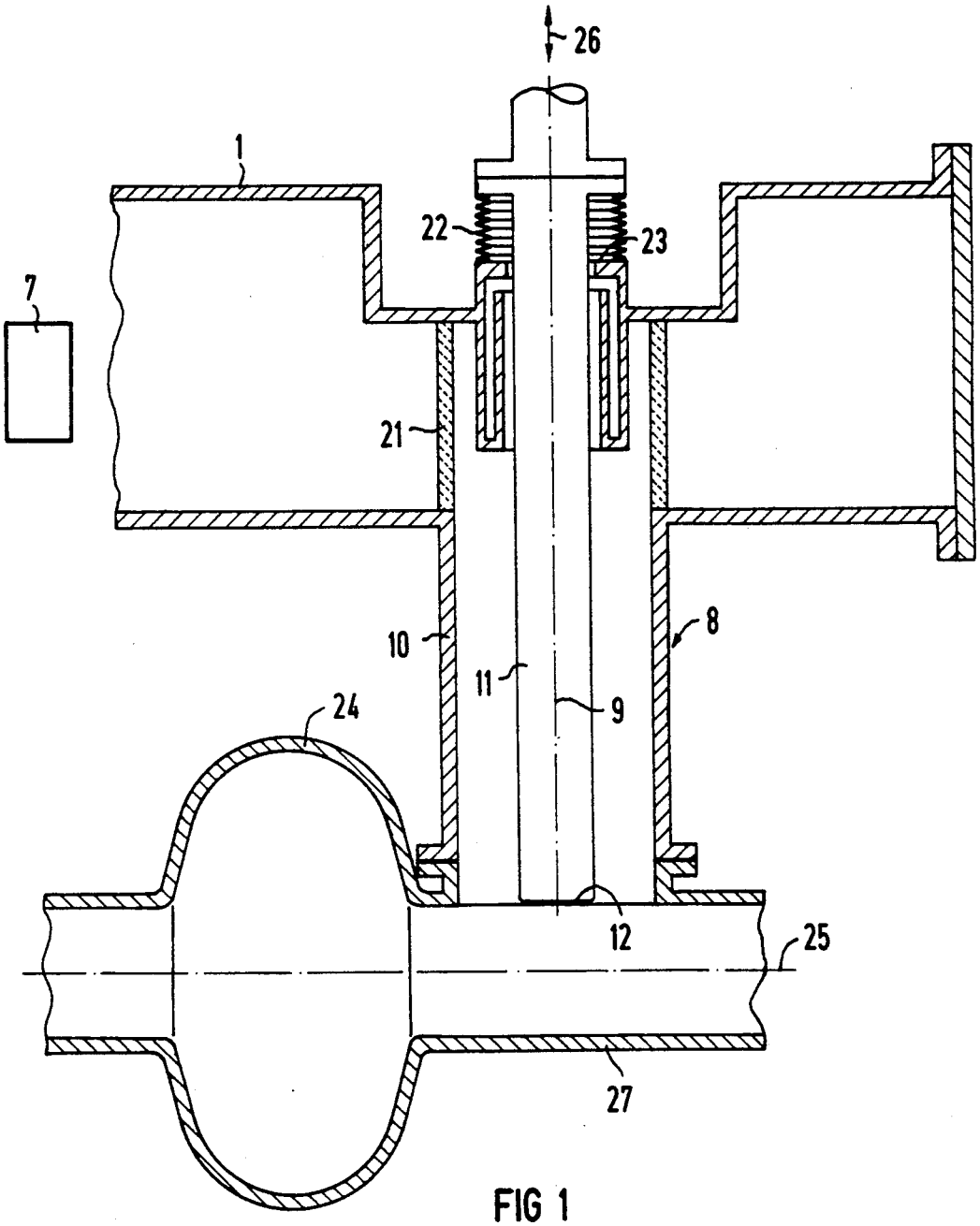
FIG. 1 is a fragmentary, diagrammatic, cross-sectional view of the power coupler according to the invention attached to a beam tube.

Referring now to FIG. 1 of the drawing in detail, there is seen a power coupler which has been developed and tested according to the invention including a tubular waveguide 1 which extends to the vicinity of a radio frequency power source 7. The coupler also includes a coaxial waveguide or coaxial line 8 with a central axis 9 which is connected to a beam tube 27 having an accelerator cavity or resonator 24 with a central axis 25. The coaxial waveguide 8 has an outer conductor 10 and an inner or center conductor 11 with a tip 12. A cylindrical ceramic window 21 which is disposed between the coaxial waveguide 8 and the high frequency power source 7 forms a vacuum barrier for the cavity 24. The frequency of the cavity 24 is below the cut-off frequency of the beam tube 27 and the outer conductor 10.

The coupler according to the invention also includes two $\lambda/4$ transformers ($\lambda$=lambda=resonance wavelength of the cavity 24) at the transition between the tubular waveguide 1 and coaxial waveguide 8 and sliding rf contacts 23 located at a position where only minimal rf currents flow. The contacts 23 make it possible to move the inner conductor 11 of the coaxial waveguide 8 by means of an external mechanical drive mechanism 26. A vacuum barrier in the form of bellows 22 is connected between the tubular waveguide 1 and the external drive 26. The mechanical drive 26 is a linear drive with high precision positioning that is integrated into the transition between the tubular waveguide 1 and the coaxial waveguide 8. The inner conductor 11 is movable through a distance of approximately 20–120 mm along the central axis 9 of the coaxial waveguide 8 by the external drive 26.

The inner conductor 11 of the coaxial waveguide 8 terminates near the beam tube 27 and serves as an antenna coupling to the cavity 24. It has been verified that the distance from the tip 12 of the inner conductor 11 to the beam tube 27 determines the coupling factor. For example, in order to vary the value of the coupling factor, it is necessary for the distance between the inner conductor 11 and the high-frequency resonator or cavity 24 to be variable. This problem is solved by making it possible to move the inner conductor 11. The tip 12 of the inner conductor 11 may protrude up to a distance of approximately 0–120 mm from the beam tube 27.

During testing, the coupler according to the invention exhibited a variation of the coupling coefficient of more than a factor of 300 with a path of mechanical movement of about 70 mm. The coupler operated without any problems on a superconducting cavity where the range of Q was adjustable between $10^7$ and $10^9$.

Through the use of two integrated 80 /4-transformers, it is furthermore ensured that on one hand, the necessary high-frequency sliding contacts 23 are essentially currentless, and that on the other hand, a short is transformed into the remaining gap between the inner conductor 11 and all components being in contact with the tubular waveguide 1. Accordingly, the coupler is constructed for high high-frequency powers to be transmitted; however, the high-frequency field can almost perfectly be kept away from the regions near the external drive 26, especially from the cavity between the inner conductor 11 and the bellows 22, thus eliminating virtually any effect of the high frequency field propagating to the accelerator cavity 24.

Figure 2:
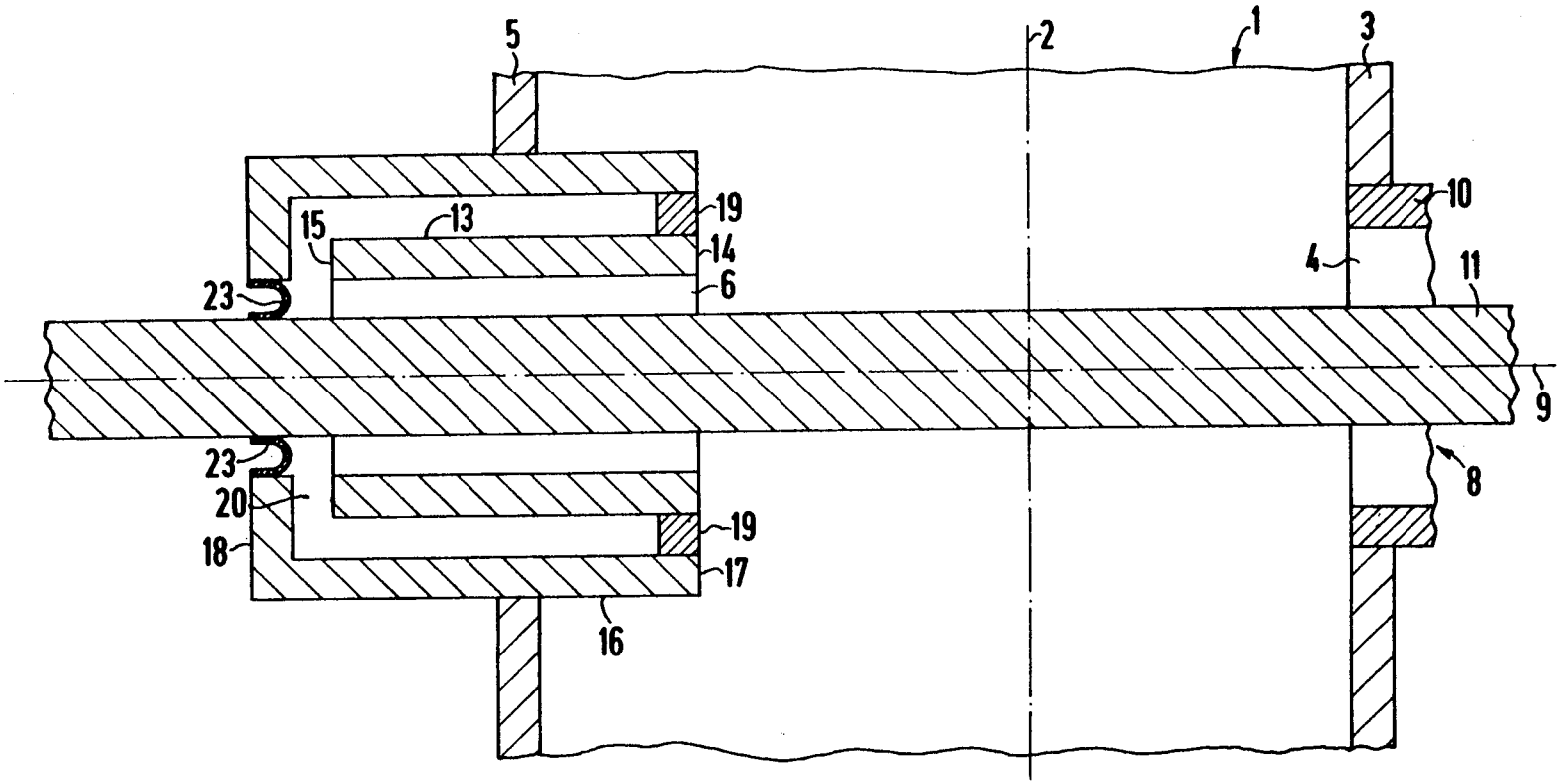
FIG. 2 shows a detailed transition between a tubular waveguide and a coaxial waveguide according to the invention.

Referring now to FIG. 2 of the drawing in detail, there is shown a transition between a tubular waveguide 1 and a coaxial waveguide 8 according to the invention. The coaxial waveguide 8 has a central axis 9 which is disposed at an angle of about 90° with respect to the central axis 2 of the tubular waveguide 1. The tubular waveguide 1 has a rectangular cross section in a plane orthogonal to its respective central axis 2; its wall comprises a flat first section 3 and a flat second section 5 which is disposed opposite the first section 3. The first section 3 has a first opening 4, where the outer conductor 10, electrically connected to the wall of the tubular waveguide 1, terminates. The inner conductor 11 extends through the tubular waveguide 1 and projects through a second opening 6 located in the second section 5, substantially opposite the first opening 4.

In order to provide an electrical connection equivalent to a short between the inner conductor 11 and the wall, while leaving the inner conductor 11 movable, sliding contacts 23 are provided. However, in high power applications, such as in accelerators, the electrical connection has to carry rather heavy loads of high frequency currents; consequently, special care must be taken to avoid very heavy currents on the sliding contacts 23. According to the invention, this is accomplished by providing two $\lambda/4$-transformers arranged collinearly with the inner conductor 11 and connected in series, thus providing a single $\lambda/2$ transformer. Accordingly, a real electric short carrying sufficiently high currents may be transformed into a "virtual" short connecting the inner conductor 11 to the flat second section 5 of the wall. An inner transformer of the $\lambda/4$ type is defined by disposing an inner tube 13 of suitable length, which provides an effective length of $\lambda/4$ or an odd multiple thereof, coaxially around the inner conductor 11; the inner transformer is the gap between the inner conductor 11 and the inner tube 13. To make an outer transformer of the $\lambda/4$ type, an outer tube 16 is disposed coaxially around the inner tube 13 in like manner, to define the outer transformer as a gap between the respective tubes. The aforesaid real short is provided in the form of a mechanically and electrically stable connection 19 between the first tip 14 of the inner tube 13 and the first tip 17 of the outer tube 16; the first tips 14 and 17 point towards the first opening 4. Respective second tips 15 and 18 of the inner tube 13 and the outer tube 16 point away from the first opening 4. The second tip 18 of the outer tube 16 carries the sliding contacts 23, thus delimiting the $\lambda/2$-transformer; the second tip 15 of the inner tube 13 is left free, leaving a gap 20 to the sliding contacts 23, in order to provide the series connection of the $\lambda/4$-transformers. Since the impedance between the first tips 14 and 17 is extremely low, a rather high impedance which in its turn entails low currents occurs between the second tips 15 and 18; as a consequence, the current load on the sliding contacts 23 is kept fairly small, so that the maximum power which may be handled by the coupler is quite considerable. Furthermore, the impedance between the first tip 14 of the inner tube 13 and the inner conductor 11 is again very low, thus assuring indeed a "virtual" short from the inner conductor 11 to the wall of the tubular waveguide 1. Preferably, the inner tube 13 as well as the outer tube 14 may be cylindrical.

It should be noted that the most important dimensions of the transition according to the invention are not the lengths of the individual λ/4-transformers, but the effective length of the λ/2-transformer as it is given by the series-connection of the two λ/4-transformers. A certain degree of deviation from an odd multiple of λ/4 of the length of an individual λ/4-transformer may indeed be tolerated with respect to the ensuing increased load on the sliding contacts 23, as long as the length of the composite λ/2-transformer amounts to a multiple of λ/2 with sufficient precision. In any case, the bandwith of the power coupler according to the invention does not turn out to be too narrow; fine tuning of each coupler to the cavity connected thereto is not considered to be necessary, if the coupler has been fabricated according to specifications given by the cavity with the usual degree of exactness.

We claim:

1. In an accelerator including a high frequency power source for generating a high frequency field for accelerating charged particles, means for supplying charged particles, a beam tube having a cavity with a cavity central axis along which the charged particles are accelerated in the high frequency field having a predetermined resonance wavelength λ and a predetermined resonance frequency associated with the cavity, a high frequency power coupling device for coupling the cavity to the high frequency power source, the coupling device comprising a coaxial waveguide having a coaxial waveguide central axis, an outer conductor and an inner conductor coaxially disposed about said coaxial wave guide central axis, said outer conductor being fixed at a first end relative to the cavity and defining an angle between the cavity central axis and the coaxial waveguide central axis, and an external drive mechanically coupled to and for moving said inner conductor along the coaxial waveguide central axis;

a tubular waveguide having a tubular wall and a tubular waveguide central axis defining an angle with the coaxial waveguide central axis, said power source coupled to said tubular waveguide for establishing said high frequency field in said tubular waveguide, said tubular wall having mutually opposite first and second openings defined therein, said outer conductor having a second end fixed at said first opening and defining an access for coupling the high-frequency field from said tubular waveguide into said coaxial waveguide, said inner conductor extending through said tubular waveguide and projecting through said second opening; and a connection between said inner conductor and said tubular wall, including an inner tube and an outer tube, each tube being electrically conductive and having a respective first tip projecting towards said first opening and a respective second tip projecting away from said first opening, said inner tube being disposed concentrically around said inner conductor defining an inner transformer having an effective length of a first odd multiple of λ/4, said outer tube being disposed concentrically around said inner tube defining an outer transformer having an effective length of a second odd multiple of λ/4, said first tip of said inner tube being electrically connected to said first tip of said outer tube, said outer tube being electrically connected to said tubular wall at a position between said first and second tips, and sliding contacts disposed on said second tip of said outer tube, said inner conductor being mechanically slidable on and electrically connected to said sliding contacts, said sliding contacts and said second tip of said inner tube defining a gap thereinbetween.

2. Coupling device according to claim 1, wherein said outer tube is a cylindrical tube.

3. Coupling device according to claim 1, wherein said angle defined between the central axis of said coaxial waveguide and the central axis of said tubular waveguide is approximately 90°.

4. Coupling device according to claim 1, wherein said inner conductor is movable through a distance of approximately 20–120 mm along the central axis of said coaxial waveguide.

5. Coupling device according to claim 1, wherein said angle between the central axis of the cavity and the central axis of said coaxial waveguide is approximately 90°.

6. Coupling device according to claim 1, wherein said inner conductor has a tip protruding up to a distance of approximately 0–120 mm from the beam tube.

7. Coupling device according to claim 1, wherein said external drive is a linear drive.

8. Coupling device according to claim 1, including vacuum barriers disposed between said coaxial waveguide and the high frequency power source as well as between said coaxial waveguide and said external drive.

9. Coupling device according to claim 1, wherein the cavity is disposed in the beam tube, and said outer conductor is connected to the beam tube near the cavity.

10. Coupling device according to claim 1, wherein said tubular waveguide is a rectangular waveguide, said tubular wall including a first substantially flat section and a second substantially flat section opposite to said first substantially flat section, said first opening being disposed in said first substantially flat section and said second opening being disposed in said second substantially flat section.

11. Coupling device according to claim 1, wherein said first odd multiple of λ/4 equals λ/4.

12. Coupling device according to claim 1, wherein said second odd multiple of λ/4 equals λ/4.

13. Coupling device according to claim 1, wherein said predetermined resonance frequency lies substantially between 40 MHz and 5 GHz.

14. Coupling device according to claim 13, wherein said predetermined resonance frequency lies between 40 MHz and 1 GHz.

15. Coupling device according to claim 1, wherein said inner tube is a cylindrical tube.

* * * * *